US006761639B2

(12) United States Patent
Todd

(10) Patent No.: US 6,761,639 B2
(45) Date of Patent: Jul. 13, 2004

(54) SAFETY BATON

(75) Inventor: Geoffrey Robert Todd, Dunedin (NZ)

(73) Assignee: Alert Trading Limited (NZ)

( * ) Notice: Subject to any disclaimer, the term of this patent is extended or adjusted under 35 U.S.C. 154(b) by 0 days.

(21) Appl. No.: 10/312,469

(22) PCT Filed: Jul. 17, 2001

(86) PCT No.: PCT/NZ01/00142

§ 371 (c)(1),
(2), (4) Date: Dec. 23, 2002

(87) PCT Pub. No.: WO02/06751

PCT Pub. Date: Jan. 24, 2002

(65) Prior Publication Data

US 2003/0139215 A1 Jul. 24, 2003

(30) Foreign Application Priority Data

Jul. 19, 2000 (NZ) ..... 505792
Dec. 21, 2000 (NZ) ..... 509071

(51) Int. Cl.[7] ..... F41B 15/02
(52) U.S. Cl. ..... 463/47.2; 463/47.6
(58) Field of Search ..... 463/47.2, 47.4, 463/47.5, 47.6, 47.7

(56) References Cited

U.S. PATENT DOCUMENTS 4,982,960 A * 1/1991 David ..... 463/47.6
5,188,362 A * 2/1993 Ashihara ..... 463/47.6
5,405,134 A * 4/1995 Wolfram ..... 463/47.4
6,499,855 B1 * 12/2002 Kukuk ..... 362/102

* cited by examiner

*Primary Examiner*—William M. Pierce
(74) *Attorney, Agent, or Firm*—Dann, Dorfman, Herrell and Skillman, P.C.

(57) ABSTRACT

Baton (1) includes two handles (14, 16), a first body portion (2) and a second body portion (3) which telescopically slides between a retracted and an expanded configuration. Retaining device (6) holds body portion (3) within body portion (2) when baton (1) is in the retracted configuration. First handle (14) is oriented perpendicular to body portion (2) and is mounted on collar (15) for rotation around body portion (2). Second handle (16) is moveable between a first position wherein handle (16) is aligned with the outer end of body portion (3), and a second position wherein handle (16) is spaced from the outer end of body portion (3) and is arranged perpendicular to second body portion (3). Baton (1) is telescopically expanded by pulling handle (16) away from body portion (2) until the pulling force exceeds the retaining force provided by retaining device (6).

22 Claims, 10 Drawing Sheets

SAFETY BATON

FIELD OF THE INVENTION

The present invention relates to a baton. In particular, the invention relates to an adjustable baton for self defence use, for example by a security guard or law enforcement officer.

BACKGROUND OF THE INVENTION

Conventional batons include an elongate baton body, and a handle fixed substantially perpendicularly to the body. While such batons offer satisfactory portability they are of limited use as they only provide a relatively short baton body and a single handle. The relatively short baton body means that there is only a limited surface for blocking attacks or using against a foe, whereas the single handled design limits the amount of force which can easily be applied through the baton.

U.S. Pat. No. 5,320,348 discloses an expandable police baton embodying a cylindrical sleeve within which is slidably disposed a cylindrical shaft. While this telescopic baton provides a longer body, it still only offers a single handle, thereby limiting the amount of force that can easily be applied through the baton.

U.S. Pat. No. 4,982,960 discloses a two-handled baton which is constructed from a hollow cylindrical shaft having a first fixed handle at one end extending perpendicularly from one side of the cylindrical shaft and a second handle normally placed close to the first handle on the same side as the first handle and parallel thereto. The second handle is spring loaded to slide from its normal position at one end of the cylindrical shaft next to the first handle towards the opposite end of the cylindrical shaft. While this baton has two handles which improve the usefulness of the baton in blocking an attack and allow extra force to easily be applied through the baton, the length of the baton body is still limited. Even though the two handles are located close to each other in the normal position, the double protruding handles would still make the baton somewhat difficult to carry, for example on a belt or in a pouch. Furthermore, having two handles which can only be moved longitudinally relative to each other on the shaft means that a user would be somewhat limited in the movement he or she could make with the baton whilst holding both handles. For example, making some rapid or complex movements with the baton while holding both handles may result in strain or injury to the user's wrists or forearms.

It is therefore an object of the present invention to provide a baton which overcomes or ameliorates at least one of the disadvantages referred to above, and/or provides the public with a useful choice.

SUMMARY OF THE INVENTION

In a first aspect, the invention broadly consists in a baton comprising: a baton body; a first handle attached to the baton body in a substantially perpendicular manner; and a second handle attached to and extending from the baton body; wherein the first handle is rotatable around the baton body.

Preferably, the first handle is rotatably attached to the baton body by a collar.

Preferably, the second handle is pivotably and slidably attached to the baton body, such that the second handle is moveable from a first position where it is disposed at a first end of the baton body substantially in line with the baton body to a second position spaced from the first end of the baton body where it is substantially perpendicular to the baton body.

The second handle suitably includes a locking mechanism to locate and hold the second handle in the second position. Preferably, the locking mechanism comprises a locking collar having at least one protrusion which is adaptable to fit into a corresponding at least one aperture in the baton body to thereby locate and hold the second handle in the second position. The locking collar is preferably spring biased towards the baton body, such that the at least one protrusion is biased into the said at least one aperture when the second handle is in the second position, and such that movement of the locking collar against the spring bias releases the second handle from the second position. The baton body advantageously has two of said at least one apertures in opposing sides of the baton body such that the second handle may be held in place by the locking mechanism when it extends substantially perpendicularly from either side of the baton body.

The second handle is preferably spring biased toward a second end of the baton body.

The body suitably defines two longitudinal slots in opposing sides thereof, and a pin extends from the second handle through the slots to enable the second handle to pivotably and slidably move relative to the baton body. A spring suitably extends from the pin to a spring mount spaced from the second handle in the first and second positions to provide the spring bias towards the second end of the baton body.

Preferably, the baton body comprises a first body portion and a second body portion telescopically slidable relative to one another such that the baton is adjustable from a retracted configuration to an expanded configuration. In this embodiment, the first and second body portions each have an inner and outer end. The baton may be moved from the retracted configuration to the expanded configuration manually. Alternatively, or in addition, the baton may be moved from the retracted configuration to the expanded configuration under the force of gravity.

Advantageously, when the second handle is in the first position and the baton is in the retracted configuration, the outer end of the second body portion is located within the second handle, and the second handle is located substantially adjacent to the inner end of the first body portion. Alternatively, the first and second body portions could be sized such that, when the baton is in the retracted configuration and the second handle is in the first position, it extends from the outer end of the second body portion and is located substantially adjacent to the inner end of the first body portion. The inner end of the first body portion and the second handle advantageously comprise complementary shaped portions such that when the second handle is in the first position and the baton is in the retracted configuration, the complementary shaped portions are in a mating configuration.

The first and second body portions each suitably comprise a hollow tube, with the second body portion being telescopically mounted in the first body portion. Advantageously, the second body portion comprises an elongate slot, and the first body portion comprises a locating means which interacts with the elongate slot to prevent rotation of the second body portion relative to the first body portion. Preferably, the locating means comprises a screw extending into the first body portion. It will be understood that other suitable locating means may be used, such as a pin or an inwardly-extending projection in the first body portion.

The first body portion preferably comprises a retaining device to hold the second body portion within the first body portion when the baton is in the retracted configuration. The retaining device advantageously comprises an end cap removably located in the outer end of the first body portion, the end cap extending into and frictionally engaging the first body portion when the baton is in the retracted configuration. Preferably, the frictional engagement is provided by a spring-loaded ball bearing which protrudes from an aperture in the end cap. The force provided by the ball bearing is advantageously adjustable. In a particularly preferred embodiment, the adjustment is provided by a grub screw which acts against the spring in the end cap.

While one particularly advantageous form of retaining device has been described, other types of retaining devices could be utilised in the baton. For example, a wire clip or other fastener could be used to hold the second body portion in the first body portion when the baton is in the retracted configuration.

In a particularly preferred embodiment, the inner end of the first body portion has an internal taper and the inner end of the second body portion is externally flared, such that when the baton is in the expanded configuration, the inner end of the first body portion and the inner end of the second body portion form a taper lock to hold the baton in the expanded configuration.

In a particularly advantageous embodiment, the length of the baton in the retracted configuration is approximately 396 mm, and the length of the baton in the expanded configuration is approximately 559 mm.

Preferably, the baton is made from aluminium alloy. However, other suitable materials having the requisite strength may be used, for example steel or polymers.

While the particularly preferred embodiment of the baton comprises a first body portion and a second body portion, the baton could have three or more telescopic body portions to thereby provide a longer baton body.

In a second aspect, the invention broadly consists in a baton which is moveable between a retracted and expanded configuration, the baton comprising: a baton body having a first body portion and a second body portion telescopically slidable relative to one another, the first body portion and second body portion each having an inner end and an outer end; a retaining device to hold the second body portion relative to the first body portion when the baton is in the retracted configuration; and a handle slidably attached to the second body portion; wherein the handle is spring biased towards the inner end of the second body portion such that, when the baton is in the retracted configuration and the handle is pulled against the spring bias away from the first body portion, the spring tension will increase until it exceeds the force provided by the retaining device, at which time the second body portion will be released from the retaining device and slide outwardly from the first body portion under momentum.

Advantageously, the handle is movable from a first position where it is disposed at the outer end of the second body portion substantially in line with the second body portion to a second position spaced from the outer end of the second body portion where it is substantially perpendicular to the second body portion.

The first and second body portions each suitably comprise a hollow tube. Advantageously, the second body portion is telescopically mounted in the first body portion, and the retaining device comprises an end cap removably located in the outer end of the first body portion, the end cap extending into and frictionally engaging the second body portion when the baton is in the retracted configuration. Preferably, the frictional engagement is provided by a spring-loaded ball bearing which protrudes from an aperture in the end cap. The force provided by the ball bearing is advantageously adjustable. In a particularly preferred embodiment, the adjustment is provided by a grub screw which acts against the spring in the end cap.

While one particularly advantageous form of retaining device has been described, other types of retaining devices could be utilised in the baton. For example, a wire clip or other fastener could be used to hold the second body portion in the first body portion when the baton is in the retracted configuration.

In a particularly preferred embodiment, the inner end of the first body portion has an internal taper and the inner end of the second body portion is externally flared, such that when the baton is in the expanded configuration, the inner end of the first body portion and the inner end of the second body portion form a taper lock to hold the baton in the expanded configuration.

The handle suitably includes a locking mechanism to locate and hold the handle in the second position. Preferably, the locking mechanism comprises a locking collar having at least one protrusion which is adaptable to fit into a corresponding at least one aperture in the second body portion to thereby locate and hold the handle in the second position. The locking collar is preferably spring biased towards the second body portion, such that the at least one protrusion is biased into the said at least one aperture when the handle is in the second position, and such that movement of the locking collar against the spring bias releases the handle from the second position. The second body portion advantageously has two of said at least one apertures in opposing sides thereof such that the handle may be held in place by the locking mechanism when it extends substantially perpendicularly from either side of the second body portion.

The second body portion suitably defines two longitudinal slots in opposing sides thereof, and a pin extends from the handle through the slots to enable the handle to pivotably and slidably move relative to the second body portion. A spring suitably extends from the pin to a spring mount spaced from the handle in the first and second positions to provide the spring bias towards the inner end of the second body portion. Advantageously, the second body portion comprises an elongate slot, and the first body portion comprises a locating means which interacts with the elongate slot to prevent rotation of the second body portion relative to the first body portion. Preferably, the locating means comprises a screw extending into the first body portion. It will be understood that other suitable locating means may be used, such as a pin or an inwardly-extending projection in the first body portion.

Advantageously, when the handle is in the first position and the baton is in the retracted configuration, the outer end of the second body portion is located within the handle, and the handle is located substantially adjacent to the inner end of the first body portion. The inner end of the first body portion and the handle advantageously comprise complementary shaped portions such that when the handle is in the first position and the baton is in the retracted configuration, the complementary shaped portions are in a mating configuration.

Advantageously, a further handle is attached to the first body portion of the baton body in a substantially perpendicular manner, wherein the handle is rotatable around the first body portion. Preferably, the further handle is rotatably attached to the first body portion by a collar which encircles the first body portion.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples only.

BRIEF DESCRIPTION OF THE DRAWINGS

The invention will now be described by way of example with reference to the accompanying drawings in which.

DETAILED DESCRIPTION OF THE PREFERRED EMBODIMENTS

With reference to FIGS. 1 to 8, the baton comprises a baton body 1 having a first body portion 2 and a second body portion 3 telescopically slidable relative to one another. The baton is extendible from a retracted configuration as shown in FIGS. 1 to 4 to an expanded configuration as shown in FIGS. 5 to 8. The first and second body portions each have inner and outer ends such that the inner end of the second body portion 3 is slidably mounted inside the first body portion 2, and the second body portion 3 extends from the inner end of the first body portion 2 in the expanded configuration.

Figure 6:
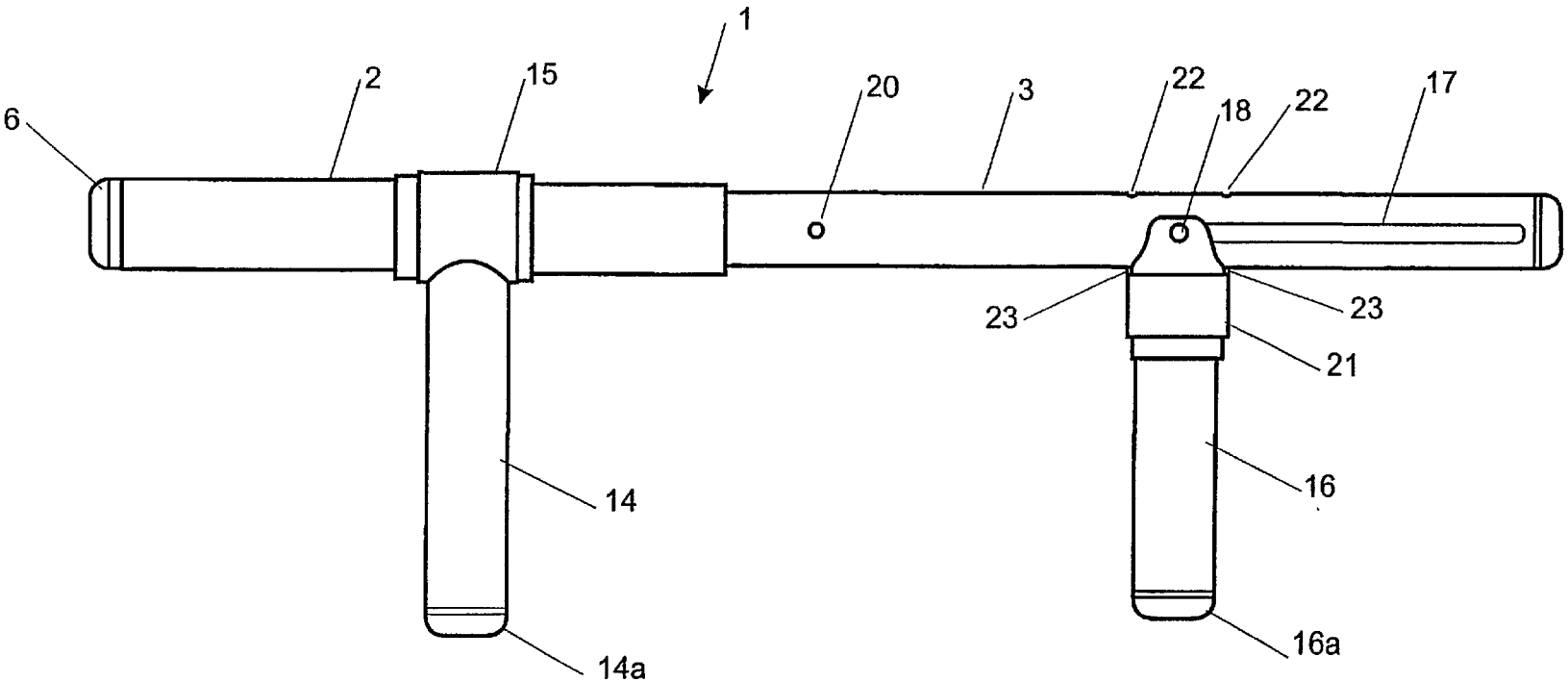
FIG. 6 shows a side view of the baton of FIG. 1 in an expanded configuration.
Figure 7:
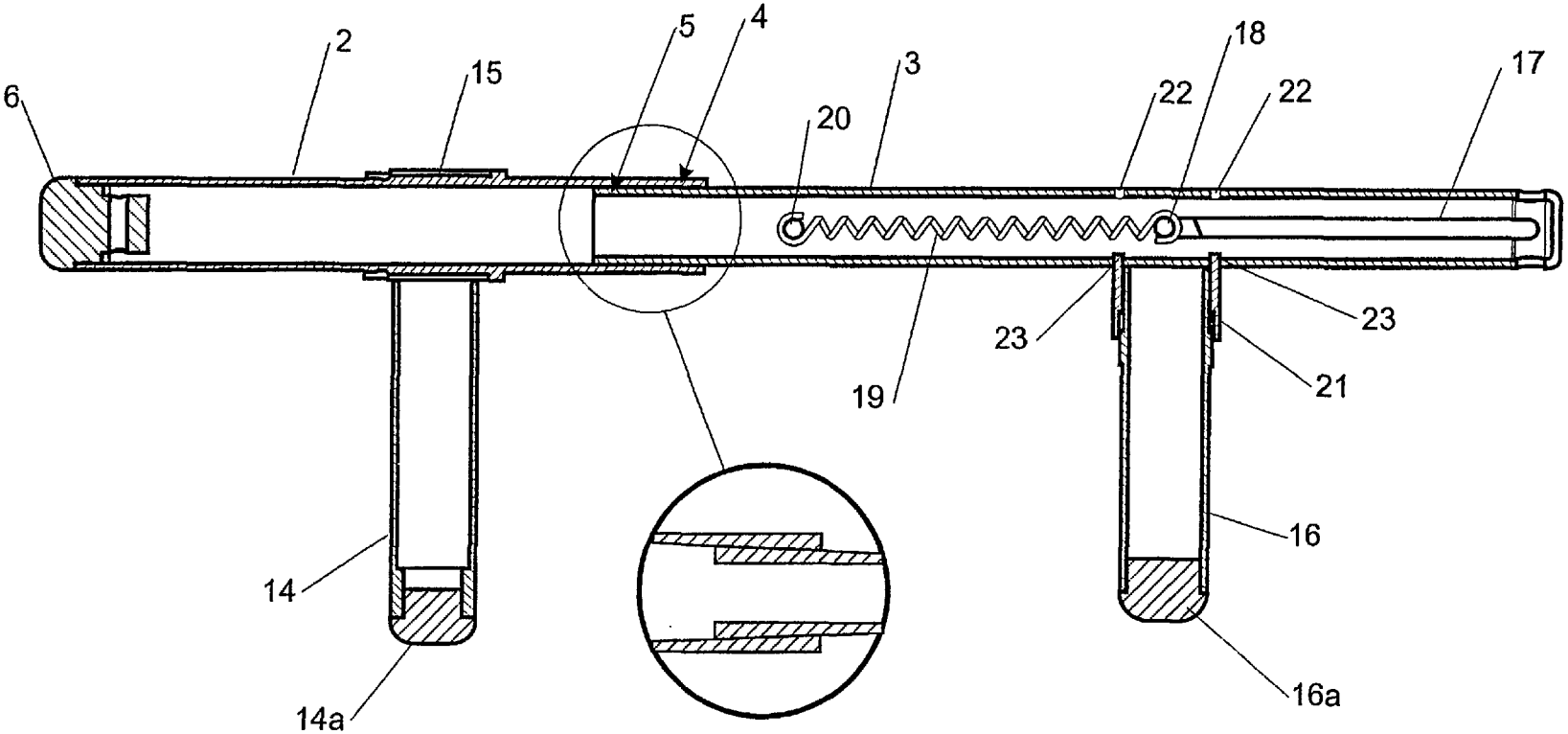
FIG. 7 shows a cross-sectional view of the baton of FIG. 1 in an expanded configuration, the section being taken through line B—B of FIG. 5.
Figure 8:
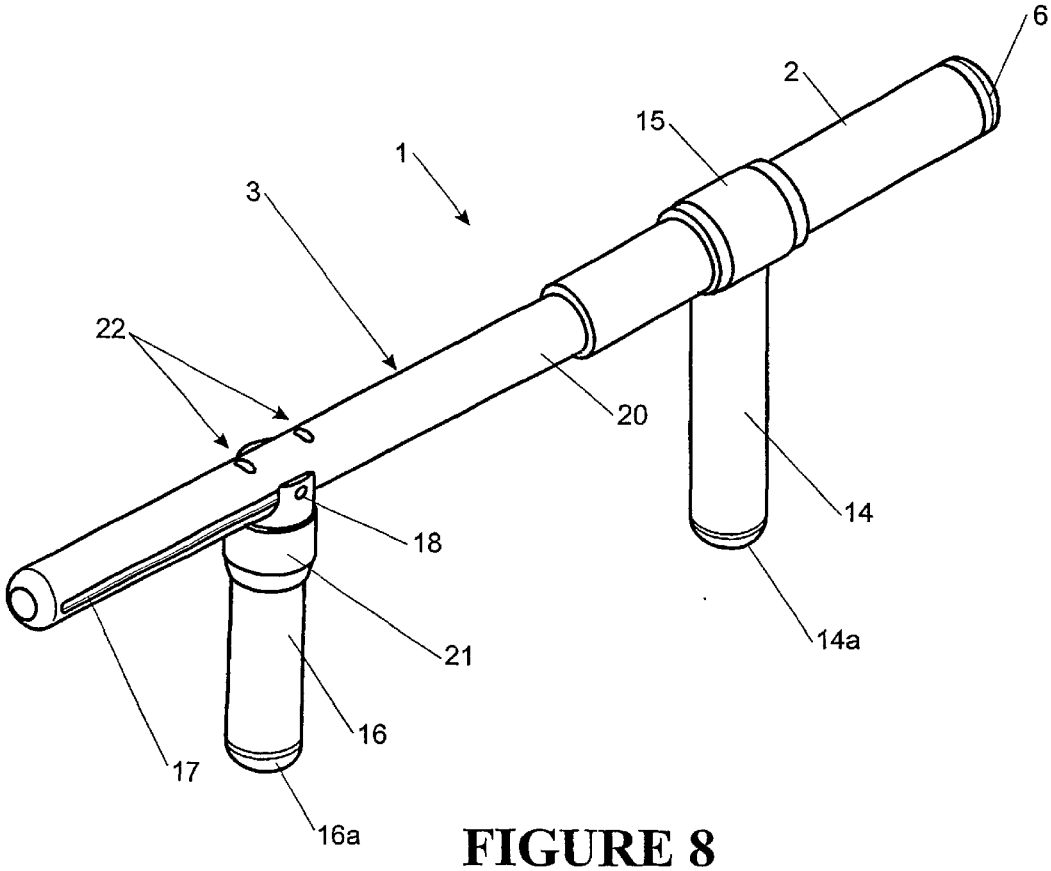
FIG. 8 shows a perspective view of the baton of FIG. 1 in an expanded configuration.

As shown in FIG. 7, the first body portion 2 and the second body portion 3 each comprise a hollow tube. The inner end of the first body portion 2 has an internal taper 4, and the inner end of the second body portion 3 has an externally flared section 5. When the baton is in the expanded configuration shown in FIGS. 5 to 8, the inner end of the first body portion 2 and the inner end of the second body portion 3 form a taper lock to hold the baton body 1 in the expanded configuration.

Figure 9:
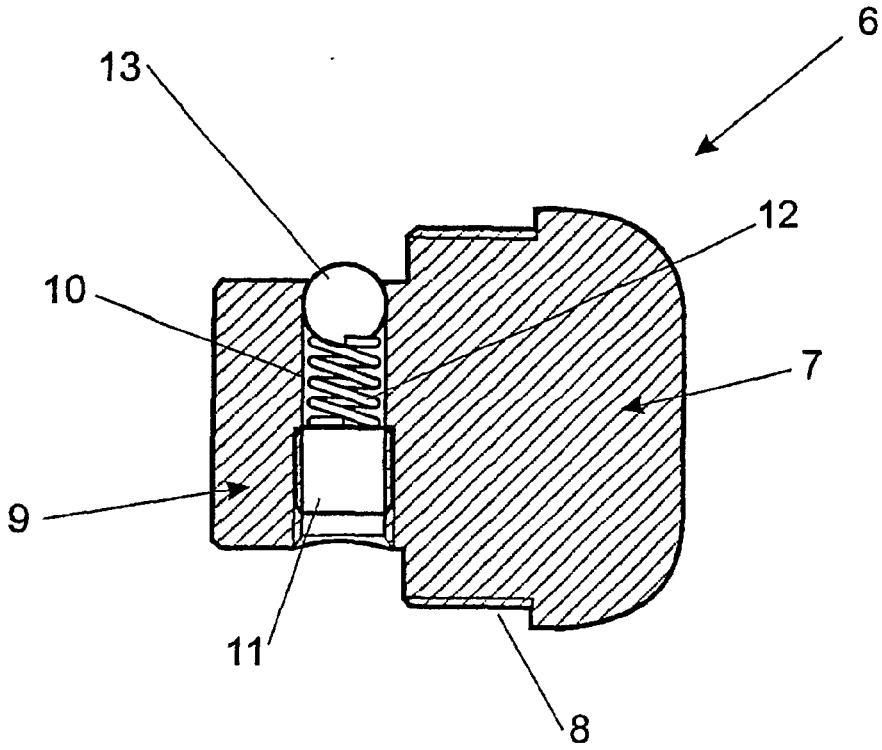
FIG. 9 shows a schematic sectional view of a preferred retaining device for use in the baton of FIG. 1.

The outer end of the first body portion 2 includes a retaining device in the form of an end cap 6 removably mounted therein, the details of which are shown in FIG. 9. The end cap 6 comprises a head portion 7, a threaded portion 8, and a body portion 9, with an aperture 10 extending diametrically through the body portion 9. The aperture 10 has a threaded section to receive a grub screw 11 which acts against a spring 12 contained in the aperture 10. The spring 12 pushes against a ball bearing 13 which partially protrudes from the aperture 10 in the body portion 9. Adjustment of the grub screw 11 adjusts the force with which the ball bearing 13 partially protrudes from the aperture 10 in the body portion 9. When the baton is in the retracted configuration, the ball bearing 13 acts against the inner surface of the second body portion 3, thereby frictionally holding the second body portion 3 within the first body portion 2.

The baton includes a handle 14 which extends in a perpendicular manner from the first body portion 2 of the baton body 1. The handle 14 is mounted on a collar 15 which surrounds and is rotatably mounted on the first body portion 2, thereby enabling the handle 14 to rotate around the first body portion 2 of the baton body 1. The handle 14 has an end cap 14*a* threadably mounted therein.

The baton includes a further handle 16 which is slidably and pivotably mounted to the second body portion 3, such that the handle 16 may be moved from a first position wherein it is disposed at the outer end of the second body portion 3 in line with the second body portion 3, as shown in FIGS. 1 to 4, to a second position shown in FIGS. 5 to 8 wherein it is spaced from the outer end of the second body portion 3 and is perpendicular to the second body portion 3. When the baton is in the retracted configuration and the handle 16 is in the first position, the outer end of the second body portion 3 is located within the handle 16. The further handle 16 has an end cap 16*a* threadably mounted therein.

Figure 1:
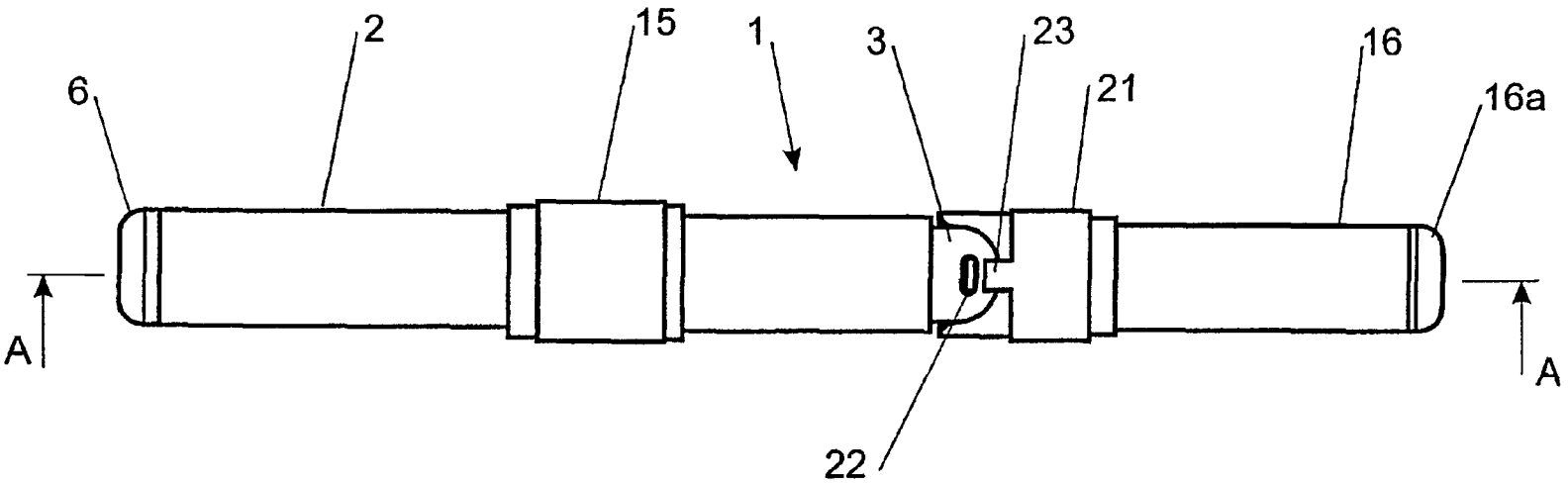
FIG. 1 shows a plan view of a baton in accordance with a preferred embodiment of the present invention, the baton being shown in a retracted configuration.
Figure 2:
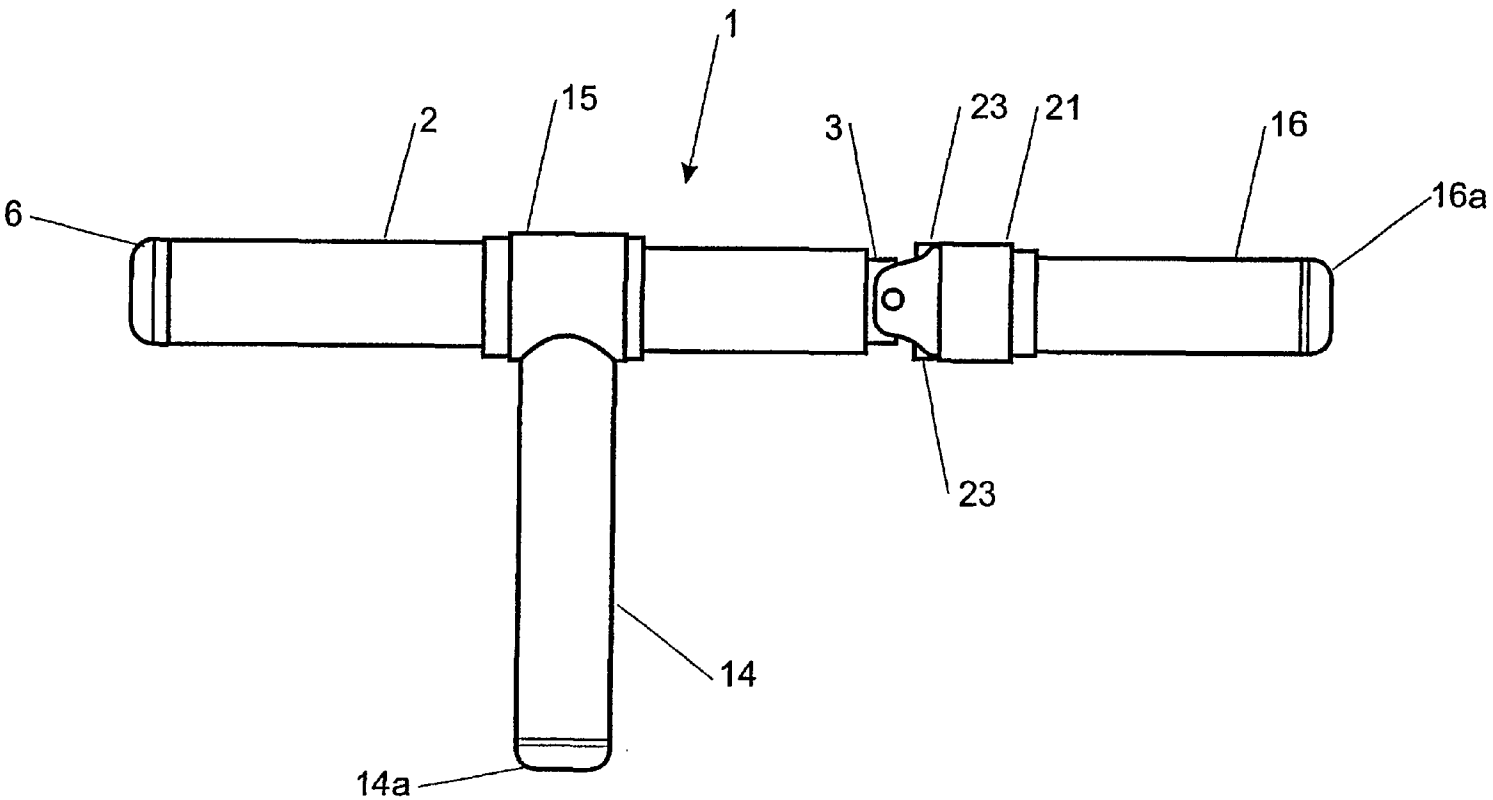
FIG. 2 shows a side view of the baton of FIG. 1 in a retracted configuration.
Figure 3:
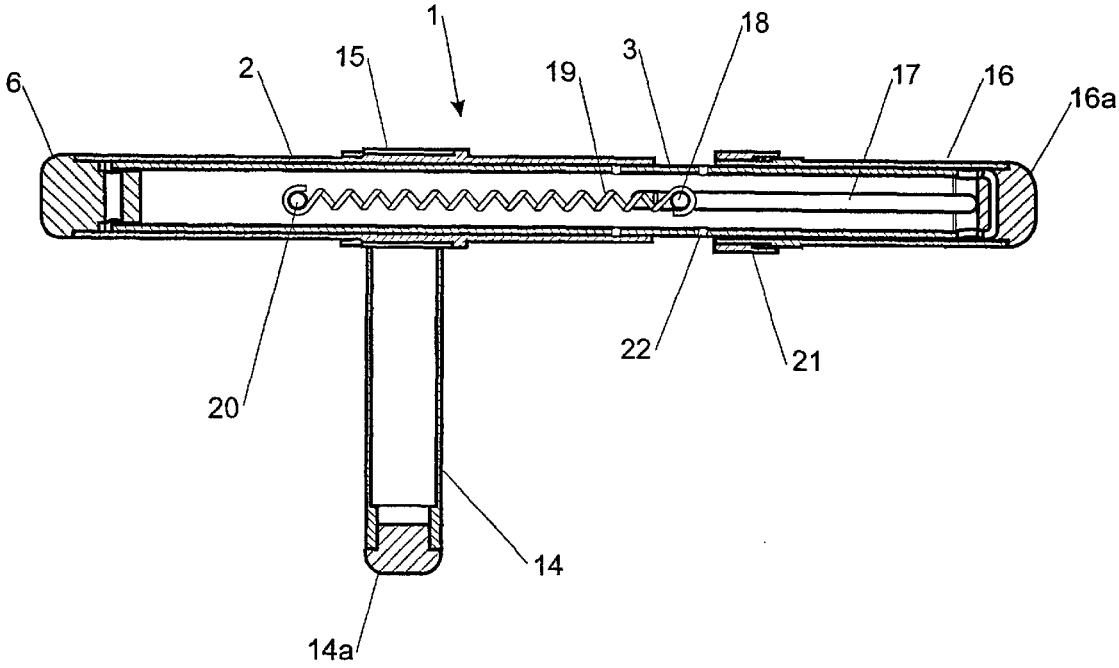
FIG. 3 shows a cross-sectional view of the baton of FIG. 1 in a retracted configuration, the section being taken through line A—A of FIG. 1.
Figure 4:
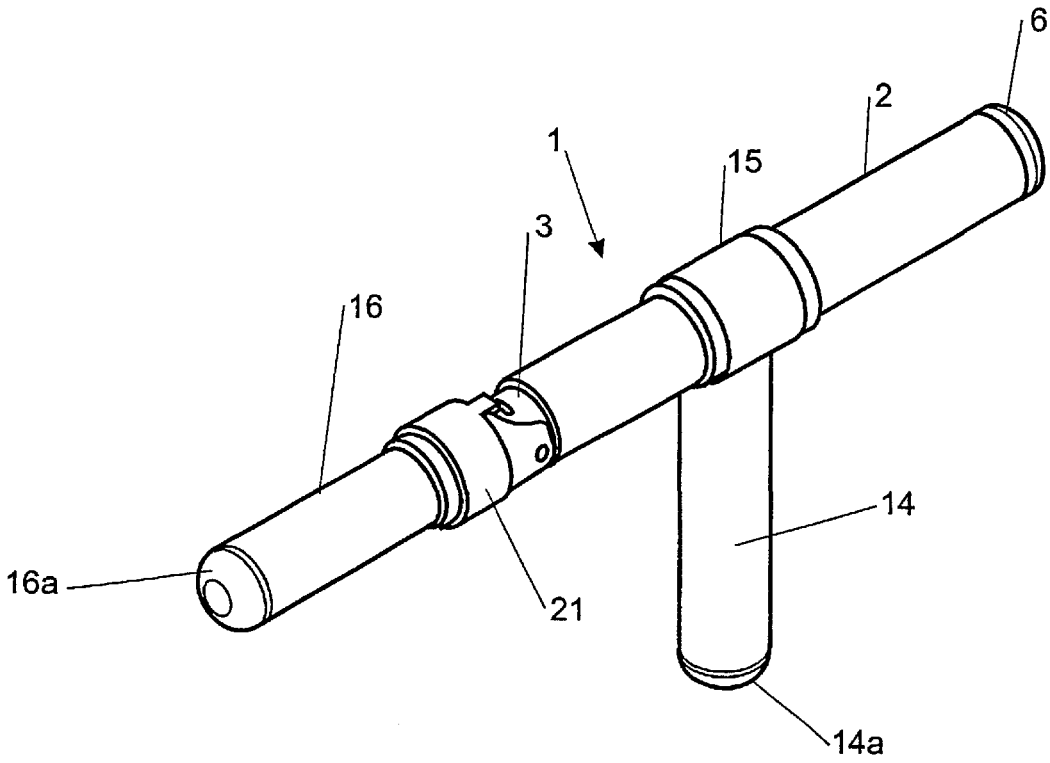
FIG. 4 shows a perspective view of the baton of the baton of FIG. 1 in a retracted configuration.
Figure 5:
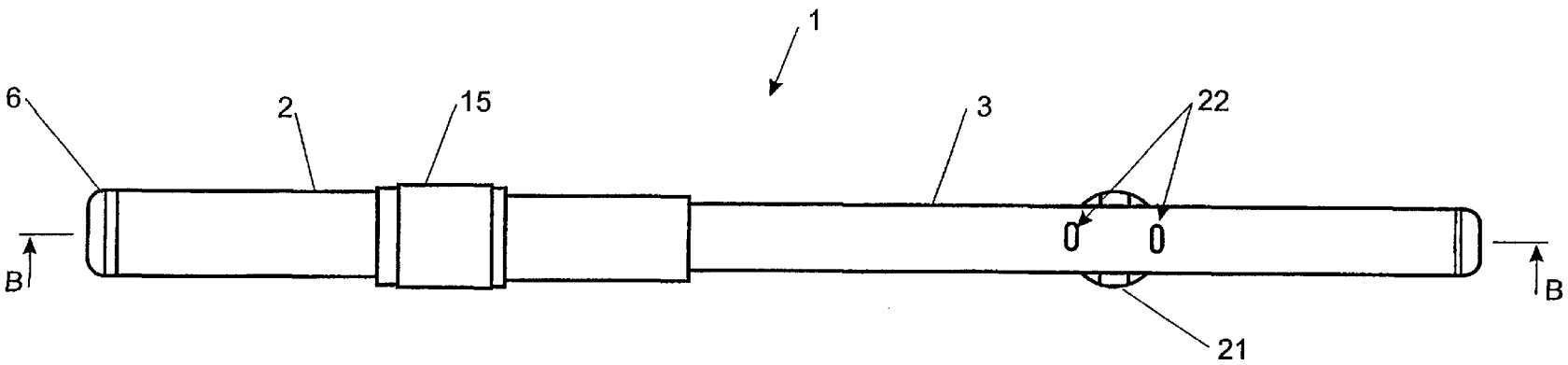
FIG. 5 shows a plan view of the baton of FIG. 1 in an expanded configuration.

As shown in FIG. 6, the second body portion 3 defines two longitudinal slots 17 in opposing sides thereof, and a pin 18 extends from the handle 16 through the slots 17 to provide the pivotable and slidable movement of the handle 16 relative to the second body portion 3. As shown in FIGS. 3 and 7, a spring 19 extends from the pin 18 to a spring mount 20 located towards the inner end of the second body portion 3 to bias the handle 16 in the direction of the inner end of the second body portion 3.

The handle 16 also includes a locking mechanism in the form of a locking collar 21 to locate and hold the handle 16 in the second position perpendicular to the second body portion 3. The second body portion 3 defines two apertures 22 on both of the two sides perpendicular to the sides in which the longitudinal slots 17 are provided. The locking collar 21 has two protrusions 23, one extending from either side of the locking collar. The locking collar is spring biased towards the second body portion 3, such that when the handle 16 is in the second position perpendicular to the second body portion 3, the protrusions 23 are located within respective ones of the apertures 22 in the second body portion 3. As the second body portion 3 defines the apertures on two sides, the handle 16 can be moved to either of the two sides to locate it in the second position perpendicular to the second body portion 3.

The body portions 2 and 3 are sized such that the overall length of the baton in the retracted configuration is approximately 396 mm, and the overall length of the baton in the expanded configuration is approximately 559 mm.

Figure 10:
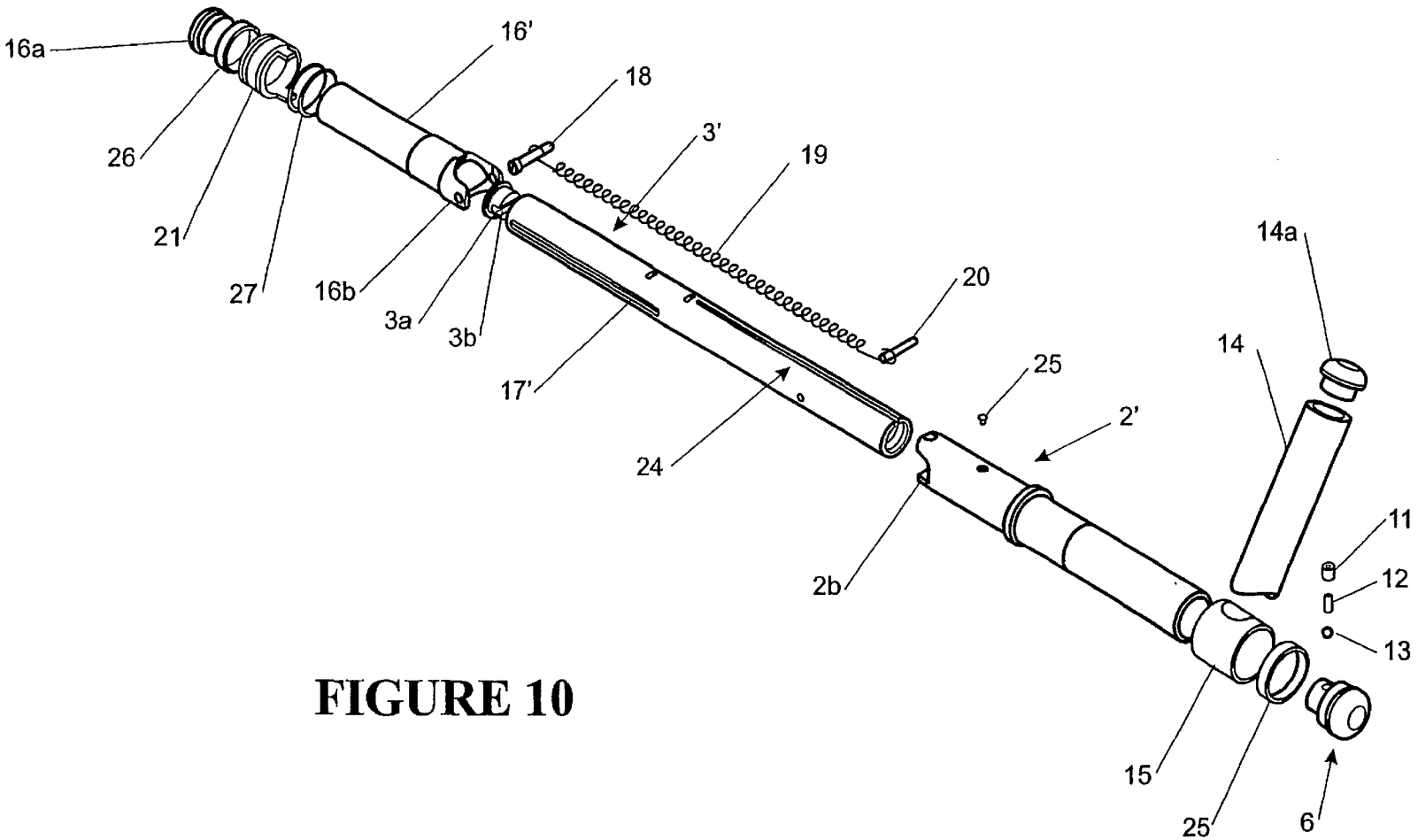
FIG. 10 shows a perspective exploded view of the components of a baton in accordance with a further preferred embodiment of the present invention.

FIG. 10 shows an exploded view of the components of an alternative embodiment of the baton, in which like numerals indicate like parts to FIGS. 1 to 9.

The baton is substantially similar to the baton shown in FIGS. 1 to 9, but differs in that the second body portion 3' includes an elongate slot 24 therein. A locating means 25 in the form of a screw extends through the first body portion 2' and into the elongate slot 24 such that the second body portion 3' is prevented from rotating relative to the first body portion 2'.

The inner end of the first body portion 2' has a shaped portion 2*b* and an end of the handle 16' has a complementary shaped portion 16*b*, such that when the baton is in the retracted configuration and the handle 16' is in its first position, the complementary shaped portions 2*b* and 16*b* are in a mating configuration.

The second body portion 3' has an end cap 3*a* mounted in its outer end, the end cap 3*a* having a transverse slot 3*b* therein which enables the pin 18 to travel substantially to the outer end of the second body portion 3'.

The rotatable handle 14 and collar 15 are located in position on the first body portion 2' by a locking ring 25 which is threadably mounted on the first body portion 2'.

The locking collar 21 is attached to the further handle 16' by a ring nut 26 which is threadably mounted on the handle 16'. A spring 27 acts between the ring nut 26 and part of the locking collar 21 to bias the locking collar 21 towards the second body portion 3'.

METHOD OF OPERATION

The baton is generally carried in the retracted configuration shown in FIGS. 1 to 4. This enables the baton to be carried in a pouch or on a belt without being of excessive length, and without the annoyance of having a second perpendicular handle. The baton may be easily used with a single hand when in the retracted configuration.

When the user wishes to convert the baton into the expanded configuration shown in FIGS. 4 to 8, he or she pulls the handle 16 longitudinally away from the first body portion 2 of the baton body 1, which causes the handle 16 to slide along the second body portion 3 away from the first body portion 2. Concurrently, the pin 18 slides within the longitudinal slot 17 against the spring bias provided by the spring 19 extending from the pin 18 to the spring mount 20 within the second body portion 3. As the handle 16 is moved towards the outer end of the second body portion 3, the tension in the spring increases. Once the tension exceeds the force provided by the ball bearing 13 of the retaining device 6 against the inner surface of the second body portion 3, the second body portion 3 is released from the retaining device 6 and slides outwardly from the first body portion 2 under momentum so that the tapered section 4 of the first body portion 2 engages with the flared section 5 of the second body portion 3, thereby forming a taper lock.

The handle 16 is then moved longitudinally to the outer end of the second body portion 3 and pivotably moved so that it is perpendicular to the second body portion 3. The handle 16 can then be moved, or moves of its own accord, under the bias of the spring 19 to the end of the slots 17 towards the inner end of the second body portion 3. The spring bias of the locking collar 21 causes the protrusions 23 to extend into the apertures 22 in the second body portion 3, thereby locating and holding the handle in the second position shown in FIGS. 5 to 8. This provides an elongated baton having two handles 14 and 16 perpendicular to the baton body 1, one of which is rotatable around the first body portion 2 of the baton body 1. This configuration enables the user to easily hold both handles of the baton, providing additional power and stability for attacking or blocking compared to that provided by a conventional single-handled baton. The rotation of one handle 14 relative to the baton body 1 and the other handle 16 enables the baton to be moved into a number of positions without a user putting unnecessary stress on their wrists or arms.

While the taper lock formed by the movement under momentum of the second body portion 3 relative to the first body portion 2 is strong, if the taper lock were to release during use, the user could pull the two handles 14 and 16 apart to re-engage the taper lock.

When the user wishes to move the baton back to the retracted configuration shown in FIGS. 1 to 4, he or she pulls the locking collar 21 away from the second body portion 3, thereby removing the protrusions 23 from within the apertures 22 in the second body portion 3. This releases the handle 16 from the second position perpendicular to the second body portion 3, and the handle can be slid towards the outer end of the second body portion 3 against the bias of the spring 19 extending from the pin 18 to the spring mount 20. Once the handle 16, and therefore the pin 18, are located at the end of the slots 17 at the outer end of the second body portion 3, the handle 16 may be pivotably moved such that it is aligned with the second body portion 3. As the internal diameter of the handle 16 is greater than the external diameter of the second body portion 3, the handle 16 may then be released so that it moves under the bias of the spring such that the outer end of the second body portion 3 is located within the handle 16.

To release the taper lock formed by the tapered section 4 of the first body portion 2 and the flared section 5 of the second body portion 3, the user may pull the handle 16 against the spring bias and subsequently force the handle 16 back in the direction of the first body portion 2 to release the taper lock. Alternatively, the user can knock the handle 16 on a solid surface such as the ground in order to release the taper lock. The second body portion 3 can then easily be moved into the first body portion 2 such that the ball bearing 13 of the retaining device 6 frictionally engages the inner surface of the second body portion 3, thereby holding the baton in the retracted configuration as shown in FIGS. 1 to 4.

While the above description of the method of operation of the baton makes reference to the baton of FIGS. 1 to 9, it will be appreciated that the baton of FIG. 10 is used in substantially the same way, and its operation need not be described separately.

It will be appreciated that the preferred embodiments of the present invention provide a baton which gives excellent portability in a retracted single-handled configuration, while enabling rapid adjustment into an expanded configuration which provides improved stability and power. Furthermore, utilising two handles, one of which is rotatable around the baton body, enables the baton to be moved into a number of positions without straining a user's wrists or arms, thereby offering improved manoeuvrability of the baton.

While the above describes preferred embodiments of the present invention, it will be appreciated that modifications may be made thereto without departing from the scope of the following claims.

I claim:

1. A baton comprising:

a baton body;

a first handle attached to the baton body in a substantially perpendicular manner and which is rotatable around the baton body;

and a second handle pivotally attached to and extending from the baton body such that the second handle is movable to a position in which it is substantially perpendicular to the baton body.

2. The baton as claimed in claim 1, wherein the first handle is rotatably attached to the baton body by a collar.

3. The baton as claimed in claim 1, wherein the second handle is moveable from a first position where it is disposed at a first end of the baton body substantially in line with the baton body to a second position spaced from the first end of the baton body wherein it is substantially perpendicular to the baton body.

4. The baton as claimed in claim 3, wherein the second handle includes a locking mechanism to locate and hold the second handle in the second position.

5. The baton as claimed in claim 4, wherein the locking mechanism comprises a locking collar having at least one protrusion which is adaptable to fit into a corresponding at least one aperture in the baton body to thereby locate and hold the second handle in the second position.

6. The baton as claimed in claim 5, wherein the locking collar is spring biased towards the baton body, such that the at least one protrusion is biased into the said at least one aperture when the second handle is in the second position, and such that movement of the locking collar against the spring bias releases the second handle from the second position.

7. The baton as claimed in claim 5, wherein the baton body includes two of said at least one apertures in opposing sides of the baton body such that the second handle may be held in place by the locking mechanism when it extends substantially perpendicularly from either side of the baton body.

8. The baton as claimed in any one of claim 1, wherein the baton body comprises a first body portion and a second body portion telescopically slidable relative to one another such that the baton is adjustable from a retracted configuration to an expanded configuration, the first and second body portions each having an inner and outer end.

9. The baton as claimed in claim 8, wherein the second body portion is telescopically mounted in the first body portion.

10. The baton as claimed in claim 8, wherein the baton may be moved from the contracted configuration to the expanded configuration manually.

11. The baton as claimed in claim 8, wherein the second handle is pivotally attached to the baton body, such that the second handle is moveable from a first position where it is disposed at a first end of the baton body substantially in line with the baton body to a second position spaced from the first end of the baton body where it is substantially perpendicular to the baton body, and wherein when the second handle is in the first position and the baton is in the retracted configuration, the outer end of the second body portion is located within the second handle, and the second handle is located substantially adjacent to the inner end of the first body portion.

12. The baton as claimed in claim 11, wherein the inner end of the first body portion and the second handle comprise complementary shaped portions such that when the second handle is in the first position and the baton is in the retracted configuration, the complementary shaped portions are in a mating configuration.

13. The baton as claimed in claim 12, wherein the inner end of the first body portion includes at least one projection which is engaged in a complementary recess in the second handle, and the second handle includes at least one projection which is engaged in a complementary recess in inner end of the first body portion, when the second handle is in the first position and the baton is in the retracted configuration.

14. The baton as claimed in claim 13, wherein the inner end of the first body portion includes two said projections and the second handle includes two said complementary recess, the second handle includes two said projections and the inner end of the first body portion includes two said complementary recess.

15. The baton as claimed in claim 9, wherein the first body portion comprises a retaining device to hold the second body portion within the first body portion when the baton is in the retracted configuration.

16. The baton as claimed in claim 15, wherein the retaining device comprises an end cap removeably located in the outer end of the first body portion, the end cap extending into and frictionally engaging the first body portion when the baton is in the retracted configuration.

17. The baton as claimed in claim 16, wherein the frictional engagement is provided by a spring-loaded ball bearing which protrudes from an aperture in the end cap.

18. The baton as claimed in claim 17, wherein the force provided by the ball bearing is adjustable.

19. The baton as claimed in claim 18, wherein the adjustment is provided by a grub screw which acts against the spring in the cap.

20. The baton as claimed in claim 9, wherein the inner end of the first body portion has an internal taper and the inner end of the second body portion is externally flared, such that when the baton is in the standard configuration, the inner end of the first body portion and the inner end of the second body portion form a taper lock to hold the baton in the expanded configuration.

21. The baton as claimed in 8, wherein the length of the baton in the contracted configuration is approximately 396 mm, and the length of the baton in the expanded configuration is approximately 559 mm.

22. The baton as claimed in claim 1, wherein the baton is made from a polymer material.

* * * * *